United States Patent [19]

Black

[11] Patent Number: 4,718,486

[45] Date of Patent: Jan. 12, 1988

[54] PORTABLE JET PUMP SYSTEM WITH PUMP LOWERED DOWN HOLE AND RAISED WITH COILED PIPE AND RETURN LINE

[76] Inventor: John B. Black, 2115 Norman, Pasadena, Tex. 77506

[21] Appl. No.: 888,726

[22] Filed: Jun. 24, 1986

[51] Int. Cl.[4] ..... E21B 19/22; E21B 43/00

[52] U.S. Cl. ..... 166/68; 166/265; 166/372; 166/385; 417/172; 417/181

[58] Field of Search ..... 166/68, 77, 105, 372, 166/371, 385, 265, 267, 106; 417/172, 181

[56] References Cited

U.S. PATENT DOCUMENTS

| | | | |
|---|---|---|---|
| 2,291,911 | 8/1942 | McMahon | 417/172 |
| 2,798,435 | 7/1957 | Armstrong | 417/234 X |
| 4,505,646 | 3/1985 | Long et al. | 417/172 |
| 4,553,590 | 11/1985 | Phillips | 166/77 X |
| 4,570,705 | 2/1986 | Walling | 166/77 |
| 4,585,066 | 4/1986 | Moore et al. | 166/77 X |

*Primary Examiner*—Stephen J. Novosad

*Attorney, Agent, or Firm*—Warren H. Kintzinger

[57] ABSTRACT

A jet pump system that is portable on a truck or equipment skid and transportable from well to well and useable from the truck or equipment skid for the lowering and withdrawal of the jet pump down and up from a well with coiled pipe and coiled return line. In one version the coiled pressure fluid pipe and coiled return line are strapped together at intervals as the pump is being lowered and the pipe and line fed down the well with the pipe being the primary support for the lowered pump, the return line and the pipe itself. In another version a motor cable reel unit lowers and raises cable that is strapped at intervals to both the pipe and the return line as a support for the lowered pump, the return line and the pipe.

18 Claims, 3 Drawing Figures

Figure 1:
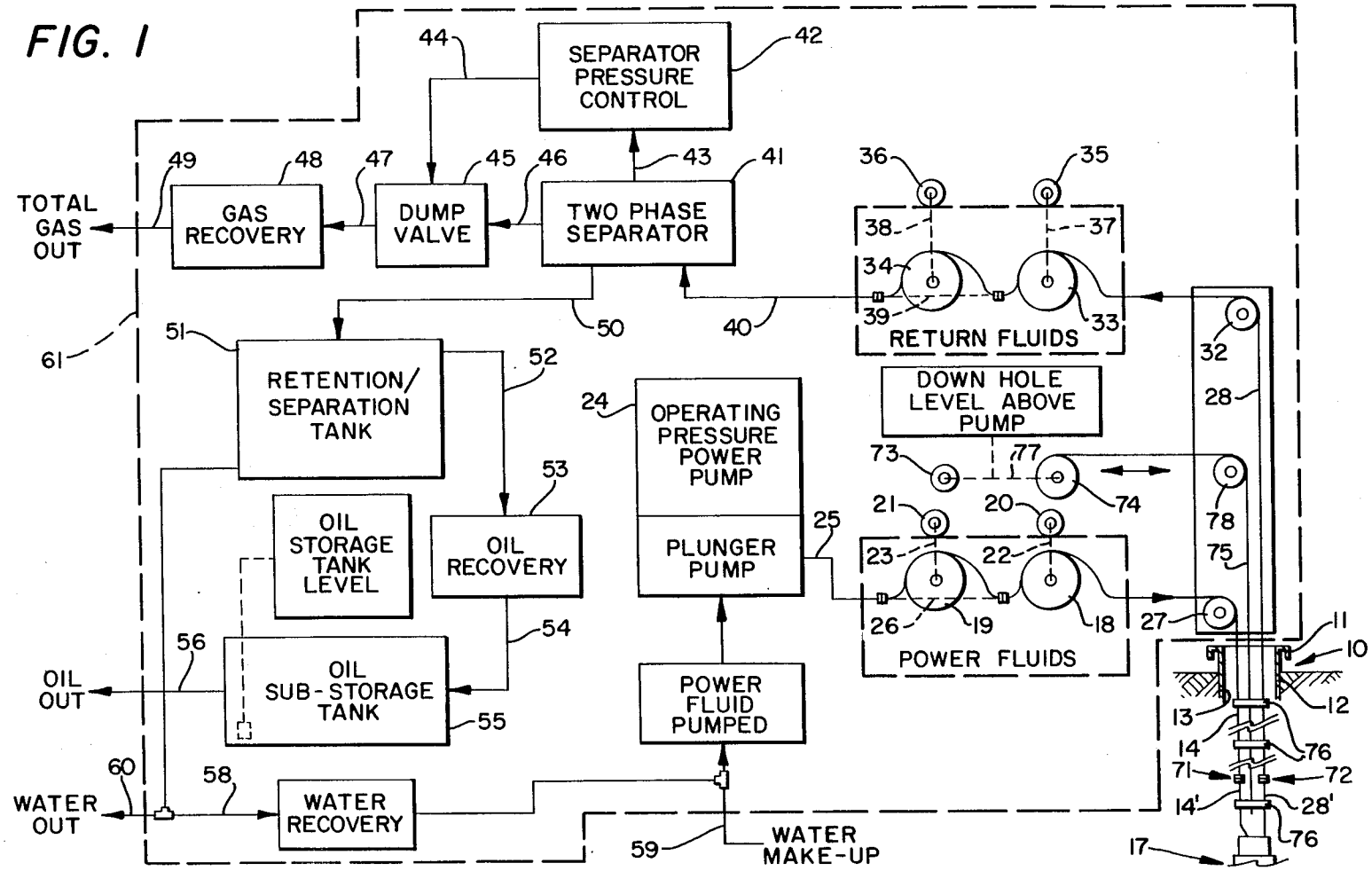

PORTABLE JET PUMP SYSTEM WITH PUMP LOWERED DOWN HOLE AND RAISED WITH COILED PIPE AND RETURN LINE

This invention relates in general to the pumping of fluids and/or gases from wells such as oil and gas wells, and more particularly to a down the hole product jet pump that is part of a portable jet pump system with the jet pump lowered down hole and raised with coiled pipe and return line.

Pump jacks, sucker rod strings and down the hole reciprocating pumps of various designs have been used in the oil patch for many years. With this old tried and proven approach there are still problems such as the reflected effect on the producing formation of cyclic on-off suction with the reciprocating action of such pumps. The old tried and true pump jack is a fairly massive piece of equipment required at each well head with such a pumping system. Further, the sucker rod string extending from the pump jack down the well to the down the hole reciprocating pump if fairly expensive and must be adequately strong to avoid breakage in the well and subsequent line fishing required to recover the broken sucker rod string. Another requirement with such reciprocating pump drive sucker rod strings is that they be tuned to the pump stroke length and length of the sucker rod string consistent with the drive imparted by the pump jack. Such problems and considerations are avoided through use of applicants new improved jet pump used down the hole with a pump recirculation water system. The new system also avoids wear between relatively moving parts such as between a sucker rod string and well tubing walls and occasional failure of such members. Such installations are generally fixed in place difficult and time consuming to install and difficult to remove. These reciprocating down the hole pumps are replaced by efficient jet pumps that generally have longer service life and that even so are part of a portable jet pump system with the jet pump quickly and easily lowered down hole and raised with coiled pipe and return line. The portable jet pump system may be permanently mounted on the bed of a truck or on a skid transported by a truck such that is may be readily transported from well to well. It is relatively easy to lower the jet pump into a well and to withdraw it from a well such that the time and expense in lowering the jet pump into a well is relatively short and modest so wells can be tested easily and if found to be worth while producers the system, if mounted on a skid, can be removed from its transport vehicle nd left in place for ongoing production. The system can be easily retrieved when production falls off and taken elsewhere. Still further, use of such jet pumps has been shown to be quite beneficial in that if a steady drawing vacuum is imposed in a well casing and on a pay zone of an oil and/or gas well during periods of pumping with lessened or eliminated well head pressure production of oil and/or gas can be significantly increased.

It is therefore a principal object of this invention to provide a jet pump system permitting the jet pump to be quickly and easily lowered into a well and to be quickly and easily removed from a well when removal is desired.

Another object is to lower maintenance and operational costs through use of such a portable jet pump system.

A further object with such a portable jet pump system is to increase production of wells and to make marginal production wells profitable.

Still another object is to lower the per well original equipment costs in the oil patch particularly with a plurality of wells.

Another object is to avoid pressure build up in the well, and generally, to avoid introduction of circulation water into the well formation.

A further object is to reduce or eliminate head pressure in the well to optimize product flow from well formation pay zones.

Features of the invention useful in accomplishing the above objects include, in a portable jet pump system with a jet pump easily lowered down the hole and raised with coiled pipe and return line, such a system mounted on a truck or on a skid that may be dismounted from a truck to facilitate movement thereof from well to well. The jet pump system is useable from a truck or equipment skid for lowering and withdrawal of the jet pump down and up from a well with coiled pipe and coiled return line. In one version the coiled pressure fluid pipe and coiled return line are strapped together at intervals as the pump is being lowered and the pipe and line fed down the well with the pipe being the primary support for the lowered pump, the return line and the pipe itself. In another version a motor cable reel unit lowers and raises cable that is strapped at intervals to both the pipe and return line as a support for the lowered pump, the return line and the pipe. The jet pump is used in a system drawing a vacuum reducing if not eliminating the effect of head pressure within the well resulting in freer fluid flow from the formation pay zone to thereby reduce costs and increase production. Water is fed downward through a pipe to the jet pump body and through the jet pump body from top to bottom to a water reversing cap that reverses the water flow and directs the water flow with entrained product from the well back up through passages in the jet pump body toward and up return flow tubing. The jet pump includes a check valve that opens for inflow of product from the well only when a drawing vacuum is created in the jet pump vacuum chamber so normal pumping flow can be stopped and reversed with the check valve closing when pumping flow stops.

Specific embodiments representing what are presently regarded as the best modes of carrying out the invention are illustrated in the accompany drawings.

Figures 2, 3:
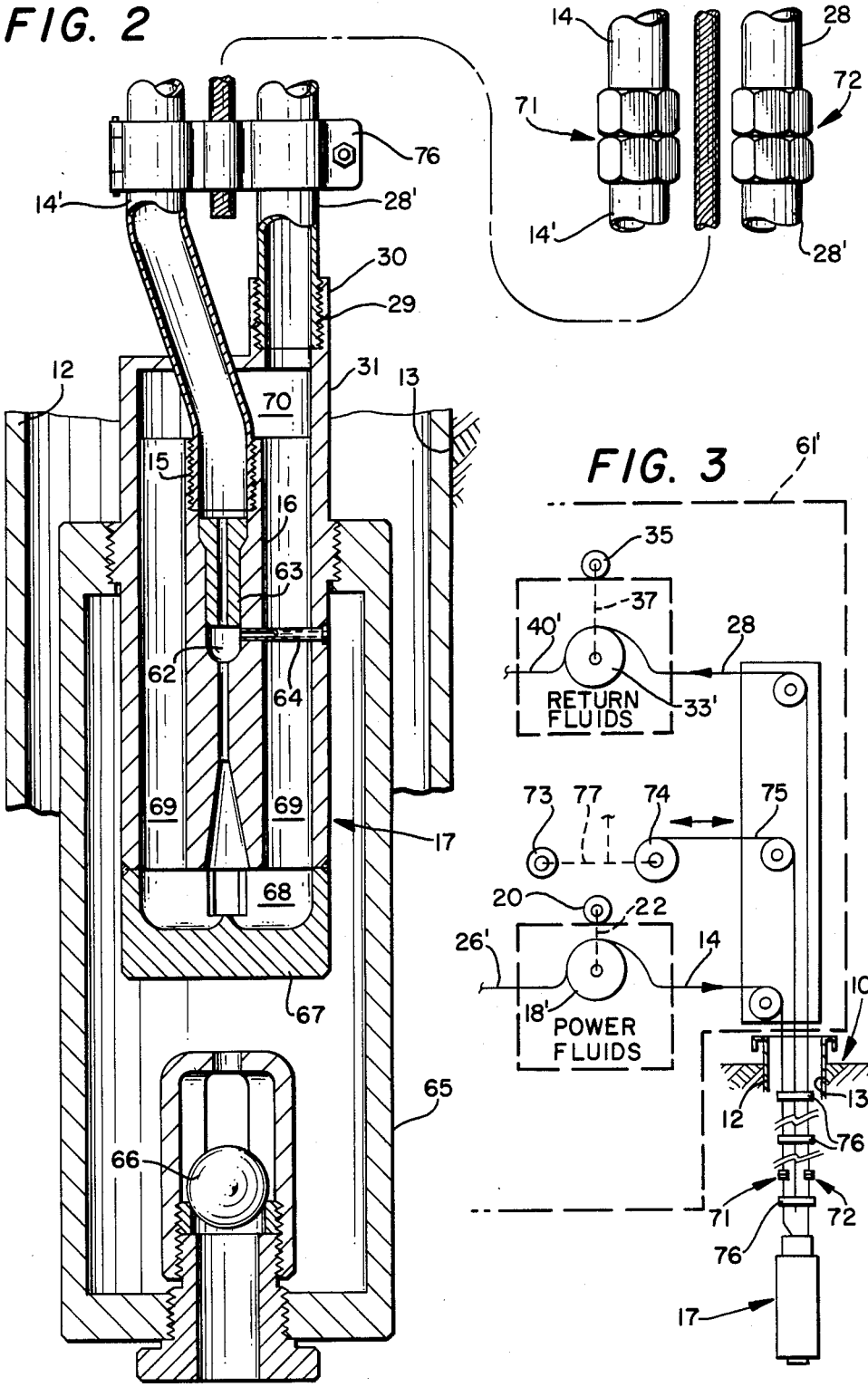

In the drawings:

FIG. 1 represents a side elevation view of an oil and/or gas well with a jet pump, that is part of a portable jet pump system, lowered down hole with coiled pipe and return line;

FIG. 2, a partially cut away and sectioned side elevation view of the jet pump down the well; and FIG. 3, a partial side elevation view of an alternate portable jet pump system from that of FIG. 1 with its jet pump lowered down hole with coiled pipe and coiled return line.

Referring to the drawings:

The oil and gas well 10 of FIG. 1 is shown to extend down from an entrance end 11 at the surface of the earth with tubular casing 12 set in place in a drilled hole 13 in the earth. A pipe 14, actually a flexible tube, extends down from the well entrance 11 to supportive connection via threaded end connection 15, referring also to FIG. 2, with the jet pump body 16 of jet pump 17 used as a down the hole pump. The flexible tube pipe 14 is fed from pipe coil reel 18 up to a first well depth range, and further fed from pipe coil reel 19 for lowering the jet pump 17 through an additional well depth range. The pipe coil reels 18 and 19 are driven by drive motors 20 and 21 through drive connections 22 and 23, respectively. For any well lowered depth from pipe coil reel 18 circulation fluids being pumped from the pumping system 24 are passed from line 25 either through the pipe coil on reel 19 or through bypass line 26 to and through a universal coupling (detail not shown) into the tubing pipe 14 of reel 18 and on down pipe 14 to the jet pump 17. Line 25 when not diverted to line 26 extends through a universal coupling into the tubing pipe 14 of reel 19 the output end of which is fastened to the input end of pipe 14 unwound from reel 18 for the lowering of jet pump 17 through an additional depth range with uncoiling of pipe 14 from reel 19. Flexible pipe 14 being lowered down the well 10 or being withdrawn from the well 10 is passed over flexible tube support guide roller 27 for properly guided entrance into and withdrawal of pipe 14 from the well 10.

A flexible tube return line 28 is, like pipe 14, connected with a supportive connection via threaded end connection 29 with the top connection extension 30 of the upper body housing 31 of jet pump 17. The tubular line 28 extends up the well 10 from the threaded end connection 29, out the well entrance end 11, and over flexible tube line support guide roller 32. Line 28 extends on to reel 33 from which it is fed as the jet pump 17 is being lowered through a first well depth range, and further fed from pipe coil reel 34 with lowering of the jet pump 17 through an additional well depth range. The line 28 coil reels 33 and 34 are driven by drive motors 35 and 36 through drive connections 37 and 38, respectively. For any well lowered depth from line reel 33 circulation fluids with well product oil and/or gas entrained therein flowing up in line 28 passes through any line 28 left coiled on reel 33 and out through a universal coupling (detail not shown) into the line 28 of reel 34 or through bypass line 39 directly to fluid passage line 40, alternately connected to a universal coupling of reel 34, that extends to separator 41. For extension of the jet pump 17 through an additional depth range with uncoiling of additional line 28 coil reel 34, that has been coupled to the line 28 section previously uncoiled from reel 34, return fluid with prodution fluid and/or gas pass out through the universal coupling of reel 34 to line 40 and separator 41. The separator 41 is shown to be a two phase separator, with separator pressure control 42 connected to the separator 41 through line 43, and an outlet control connection 44 to dump valve 45 periodically activated to pass gas through line 46 from separator 41 on through line 47 through gas recovery unit 48 and on out through line 49. Line 50 passes oil and circulation pumping fluid to the retention and separation tank 51 that has an upper level oil out flow line 52 connected to oil recovery 53 and oil line 54 to oil sub-storage tank 55 that has an oil line 56 connection to off the vehicle (or skid) 57 storage (not shown). A lower recovered circulation water (or other circulation fluid) line 58 flows to and through water recovery as the power circulation fluid pumped as circulation water to the pumping system 24. Obviously, if water make up is required it is drawn in from a water make up source through line 59 to line 58 and conversely if there is excess water in the circulation system excess water is valved (detail not shown) to flow out water out line 60 from line 58.

The jet pump system is portable on a truck mounted directly on the truck and useable from the truck or is mounted on an equipment skid 61 transportable from well to well and useable from the skid on a truck or dismounted from a truck or trailer for on site lowering and withdrawal of the jet pump 17 down and up from a well. The jet pump 17 has a venturi vacuum drawing chamber 62 with high velocity circulating fluid flow from nozzle 63 drawing well product fluids and/or gases through a fluid passage tube 64 from chamber enclosure 65 and through ball check valve 66 from the well casing 12 below the jet pump 17. The jet pump 17 also includes a bottom fluid reversing cap 67 where fluid flow is redirected upward in fluid fluid reversing chamber 68 to flow upward in openings 69 to the top interior space 70 within upper body housing 31 from which fluid flows up flexible tube return line 28. Each of the reels 18 and 19 and 33 along with 34 carry approximately 4,000 feet of pipe 14 or return line 28, respectively. The bottom ends of pipe 14 and return line 28 are connected via coupling assemblies 71 and 72 to relatively short interconnect pipe and line extensions 14' and 28', respectively, that provide the connections to the top of the jet pump 17. The coiled pipe 14 and coiled return line 28 are played out with reel motors 20 and 35 being controlled for synchronized feed or return coiling with the pipe and line fed down the well (or raised) with the pipe 14 being a primary support for the lowered pump, the return line and the pipe itself. The fluid pipe 14 and return line 28 may be strapped together at intervals as the pump is being lowered and then the strap sections are removed as pipe 14 and line 28 are raised and recoiled on reels.

When a jet pump 17 is lowered to greater depths a motor 73 driven cable reel 74 unit lowers and raises cable 75, that is strapped at intervals to both the pipe 14 and return line 28 by cable, pipe and return line strap units 76, as a support for the lowered pump 17 the return line 28 and the pipe 14. The motor 73 is drive 77 connected to cable reel 74 from which cable 75 is passed over cable guide roller 78 for properly guided entrance into and withdrawal from the well 10. With the double reel 18 and 19 and double reel 33 and 34 embodiments of FIG. 1 when the pipe reel 18 and the return line reel 33 are unwound the upper ends of the pipe 14 and line 28 therefrom are coupled by additional coupling assemblies 71 and 72 to ends of additional pipe 14 and line 28 from reels 19 and 34 to enable further lowering of the jet pump 17 from 4,000 foot depth for example to as much as 8,000 feet for example if needed in a well.

Referring now to the portable jet pump 17 system of FIG. 3 for a lighter portable unit mounted on a truck or on a skid that may be carried by a truck or trailer from well location to location, this embodiment employs only one motor 20 driven reel 18' for pipe 14 and only one motor 35 driven reel 33' for return line 28 with items being the same having the same identification numbers as primed numbers as a matter of convenience. Operation with this embodiment of less depth capacity than with embodiment of FIG. 1 is substantially the same and is not described again in detail for this FIG. 3 embodiment.

Whereas this invention has been described with respect to several embodiments thereof, it should be realized that various changes may be made without departure from the essential contributions to the art made by the teachings hereof.

I claim:

1. A portable jet pump with the jet pump lowered down hole and raised with uncoiling and coiling of pipe and return line comprising: a portable well jet pump system including, a jet pump connected to a pipe and a return line that are feedable from the coiled state and in return back to the coiled state on pipe coil reel means and on return line coil reel means, respectively; first drive means for said pipe coil reel means, and second drive means for said return line coil reel means for uncoiling said pipe and said return line to lower said jet pump down a well and for coiling of said pipe and said return line in withdrawing said jet pump from a well; transport means mounting said portable well jet pump system for movement to wells to be pumped and from well to well; wherein said pipe is flexible tubing; and said return line is a flexible tube return line; a first flexible tubing guide roller is mounted on said transport means for properly guided entrance into and withdrawal of said pipe flexible tubing from a well; and a second flexible tubing guide roller mounted on said transport means for properly guided entrance into and withdrawal of said flexible tube return line from a well.

2. The portable well jet pump system of claim 1, wherein strap clamp means are clamped on and strap said pipe flexible tubing and said flexible tube return line together at intervals as said pipe flexible tubing and said flexible tube return line are played out from said pipe coil reel means and said return line coil reel means with lowering of said jet pump down a well.

3. The portable well jet pump system of claim 2, wherein said pipe flexible tubing provides support for said flexible tube return line and for said jet pump down the well.

4. The portable well jet pump system of claim 2, wherein both said pipe flexible tubing and said flexible tube return line provide support for said jet pump down the well.

5. The portable well jet pump system of claim 4, wherein a cable reel and a cable reel drive motor are mounted on said transport means for driving cable from said cable reel that is strapped at intervals to both said pipe flexible tubing and said flexible tube return line by said strap clamp means as a support for the lowered jet pump, said pipe flexible tubing, and said flexible tube return line.

6. The portable well jet pump system of claim 5, wherein said transport means is an equipment mounting skid transportable from well to well.

7. The portable well jet pump system of claim 5, where said transport means is a truck.

8. The portable well jet pump system of claim 5, wherein said jet pump is of the type drawing a vacuum reducing if not eliminating the effect of head pressure within a well resulting in freer fluid flow from a well formation pay zone; the jet pump operates with circulation fluid pumped downward through said pipe passing through the jet pump body and through a jet pump vacuum chamber within the jet pump body.

9. The portable well jet pump system of claim 8, wherein surface pumping circulation fluid system equipment is mounted on said transport means.

10. The portable well jet pump system of claim 9, wherein said jet pump includes a check valve that opens for inflow of product from the well only when a drawing vacuum is created in the jet pump vacuum chamber so normal circulator fluid pumping flow can be stopped with the check valve closing when pumping flow stops.

11. The portable well jet pump system of claim 10, wherein said pipe coil reel means is a single pipe coil reel; and said return line coil reel means is a single return line coil reel.

12. The portable well jet pump system of claim 10, wherein said pipe coil means is two tandem pipe coil reels; and said return line coil reel means is two tandem return line coil reels.

13. The portable well jet pump system of claim 12, wherein there is a motor drive, individually, for each of said two tandem pipe coil reels and for each of said two tandem return line coil reels.

14. The portable well jet pump system of claim 10, wherein separator means for separation of gas from fluids is connected to receive product and circulation fluid from the well via said return line means; and with said separator means mounted on said transport means.

15. The portable well jet pump system of claim 14, wherein a fluids retention and separator tank separates oil and circulation fluid; and said fluids retention and separator tank is mounted on said transport means.

16. The portable well jet pump system of claim 15, wherein a high level outlet of said fluids retention and separation tank is connected for drain off of oil; and a low level outlet of said fluids retention and separation tank is connected for circulation fluid circulation pumping system recovery and pumping through said pipe when the jet pump is being operated by the through flow of circulation fluid.

17. The portable well jet pump system of claim 16, wherein said circulation fluid circulation pumping system is mounted on said transport means.

18. The portable well jet pump system of claim 17, wherein said circulation fluid is water; and excess water outflow valve means is provided on said transport means.

* * * * *